US006634507B1

(12) United States Patent
Høst-Madsen et al.

(10) Patent No.: US 6,634,507 B1
(45) Date of Patent: Oct. 21, 2003

(54) CLEANING SYSTEM FOR TRAY

(75) Inventors: Knud Høst-Madsen, Hellerups (DK); Klaus Schnellmann, Niederweningen (CH)

(73) Assignee: Gate Gourmet Switzerland GmbH, Glattbrugg (CH)

( * ) Notice: Subject to any disclaimer, the term of this patent is extended or adjusted under 35 U.S.C. 154(b) by 0 days.

(21) Appl. No.: 09/831,502

(22) PCT Filed: Oct. 5, 1999

(86) PCT No.: PCT/CH99/00471

§ 371 (c)(1),
(2), (4) Date: Sep. 21, 2001

(87) PCT Pub. No.: WO00/30522

PCT Pub. Date: Jun. 2, 2000

(30) Foreign Application Priority Data

Nov. 21, 1998 (EP) ..... 98122097

(51) Int. Cl.[7] ..... A47L 15/24
(52) U.S. Cl. ..... 209/702; 209/705; 134/133
(58) Field of Search ..... 198/435, 346; 209/702, 155, 705, 942; 134/25.2, 56 D, 62, 133

(56) References Cited

U.S. PATENT DOCUMENTS 3,698,407 A * 10/1972 Noren ..... 134/60
3,857,463 A * 12/1974 Wagenfuhrer et al. ..... 186/1 R
3,939,854 A * 2/1976 Kitterman et al. ..... 134/72
3,990,571 A * 11/1976 Kitterman et al. ..... 198/356
4,014,356 A * 3/1977 Carieri ..... 134/63
4,233,083 A * 11/1980 Roberts ..... 134/63
4,317,514 A 3/1982 Noren
4,334,547 A * 6/1982 Diebel et al. ..... 134/46
4,410,081 A * 10/1983 Weihe, Jr. ..... 198/725
4,561,144 A * 12/1985 Marais ..... 15/302
4,603,771 A * 8/1986 Felder ..... 198/367
4,676,365 A * 6/1987 Noren ..... 198/803.14
5,067,192 A * 11/1991 Guelfi et al. ..... 15/302
5,284,252 A * 2/1994 Bonnet ..... 209/552
5,464,032 A * 11/1995 Litterst ..... 134/72
5,499,719 A * 3/1996 Lindee et al. ..... 209/703
5,622,196 A * 4/1997 Luongo ..... 134/131
6,223,502 B1 * 5/2001 Cress et al. ..... 53/426
6,286,522 B1 * 9/2001 Host-Madsen et al. .... 134/25.2

FOREIGN PATENT DOCUMENTS

DE 196 29 325 1/1998
WO 98/04180 2/1998

* cited by examiner

*Primary Examiner*—Douglas Hess
(74) *Attorney, Agent, or Firm*—Finnegan, Henderson, Farabow, Garrett & Dunner, L.L.P.

(57) ABSTRACT

The system for cleaning items by using washing baskets (7) comprises a stripping station (A), a tunnel washer (2) and, on the clean side, a station (B) for storing and unpacking items from the washing baskets, as well as a washing basket return equipment comprising two separate return conveyors (8, 9), one (9) arranged above and the other (8) arranged underneath a table (10) in station (B) and leading back to the top of the stripping station (A). The clean baskets (7) are manually put onto the conveyors (8, 9) in station (B) and manually discharged from the conveyors (8, 9) in station (A) for reuse.

5 Claims, 1 Drawing Sheet

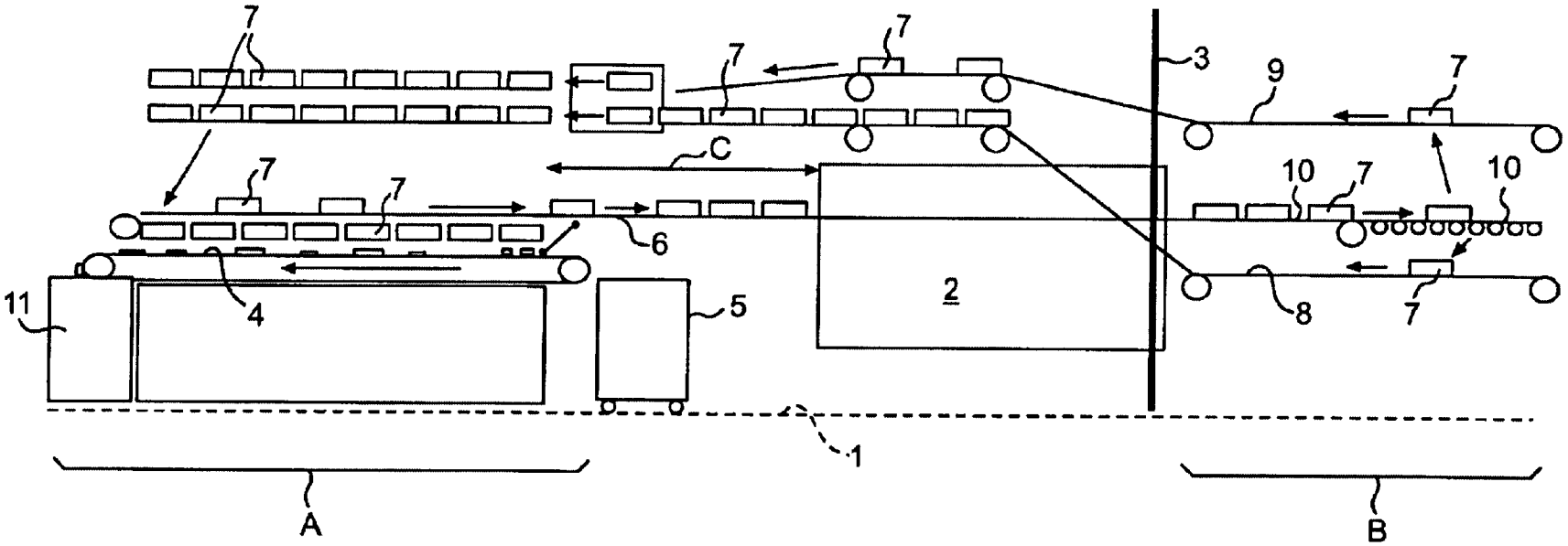
7
10
7
7
10
9
8
3
B
2
7
1
7
C
5
6
7
A
7
7
4
11

CLEANING SYSTEM FOR TRAY

BACKGROUND OF THE INVENTION

The present invention relates to a system for stripping soiled trays and bulk items returned from meal services, specifically trays and bulk items from airline trolleys, and for cleaning items to be reused.

Systems of the type defined above are in use particularly with airline caterers.

For operators working in the stripping area of the flow line of the system, it is important to have washing baskets of the right size for taking up items to be cleaned in close reach at the right time. Basically two washing basket types shall be used for ideal positioning of items having to go through a washing machine.

It is an object of the present invention to provide a system of the kind defined hereinabove which permits stripping of soiled trays and bulk items and enables cleaning (washing) of the items in a most economic manner.

SUMMARY OF THE INVENTION

This object is achieved in accordance with the present invention by a system of the type as defined above and comprising a stripping station on the dirty side, in which the items to be cleaned are put into washing baskets, a tunnel washer for the washing baskets filled with items and, on the clean side, a station with a table for storing and unpacking the cleaned items from the washing baskets, further comprising a washing basket return equipment for returning the clean emptied washing baskets from the storing and unpacking station to said stripping station, wherein the equipment comprises two motor-driven return conveyors, one arranged above and the other arranged underneath said table at the storing and unpacking stations and leading back to the top of the stripping station for manual removal by the operators working in the stripping station.

The system consists mainly of a stripping station forming the so-called dirty side and asking for washing baskets for the further processing of the items to be cleaned, a tunnel washer, a station for storing and unpacking the cleaned items leaving the tunnel washer and finally a washing basket return equipment or installation for returning the emptied clean washing baskets to the stripping station. A main part of the system is the specific and inventive construction of the basket return equipment.

BRIEF DESCRIPTION OF THE DRAWINGS

The invention will be explained in more details in connection with an embodiment shown in the accompanying drawing, in which the only figure shows in a purely schematic manner the system according to the present invention.

The drawing shows the entire flow line between a stripping station A (on the dirty side) and the storing and unpacking station of washing baskets B (clean side).

DETAILED DESCRIPTION OF THE INVENTION

The whole system is ending on a floor 1 for wet operation. Drain channels (not shown) where necessary are arranged along the system (along the stripping station A and the tunnel washer 2).

A wall 3 separates the dirty and clean side of the system for hygienic reasons. A wall 3 surrounding the tunnel washer 2 with through-passages for conveyors (see below) is particularly suitable and forms a bar against noise and humidity.

In the embodiment shown the stripping station A is on the left side. The stripping table 4 formed by an endless conveyor with drainage holes supports items supplied from trolleys 5, e.g. trolleys for standard boxes.

The items to be cleaned are placed into washing baskets 7 onto a conveyor 6 leading through the tunnel washer 2 straight or with 45° or 90° bends. The length between stripping station and washer is sufficient to form a buffer zone C.

The trolleys 5 can be lifted by a trolley lifter (not shown) in order to facilitate unpacking the boxes and arranging the items to be cleaned on the stripping table 4.

In the station B on the right side the washing baskets 7 are temporarily stored and unpacked (the unpacked items on the clean side can be directly packed into carriers, not shown), ready to be used in a tray setting system.

The washing baskets 7 in station B, once unpacked, are manually put either on a conveyor 8 beneath table 10 (low baskets) or a conveyor 9 above table 10 (any height) for being returned to the top of the stripping station A from where an operator on either side of the stripping station A or even from the front end thereof may manually pick them up for new use (for filling them with items to be cleaned).

It is repeated, that for operators working in the stripping station A of the flow line, it is important to have washing baskets 7 in close reach of the right type at the right time.

Basically two washing basket types 7 are used for ideal positioning of items having to go through the washing machine (with and without pegs).

On the clean side operators, put the empty baskets 7 on one of the two conveyors 8, 9, this way the baskets 7 are already separated for type (e.g. size). The lower basket return conveyor 8 has a relatively narrow slot to put the baskets 7 on the conveyor, allowing only for low baskets to be put on.

The upper conveyor 9 is free in height and allows for any height basket 7 to be put on including special baskets for glasses and cutlery (with inserts)

The baskets 7 are moved on the conveyors 8, 9 back and up (with slopped conveyors) to a position in front and on top of the actual stripping station A.

For reach and ergonomy in this area a two-track system is preferable, so that from each side of the stripping line an operator can easily reach for baskets for the operation. This is solved with a switch (similar to railroads) and the rail tongue is guiding the baskets 7 to either side, or for one sided operation to one side of the stripping station only.

By special conveyors above the stripping station, the baskets 7 are moved to the far end of the system where another operator can use baskets for stripping glasses in racks on a special table.

The items arriving from the washing machine in baskets 7 are packed into bins (not shown) and stored in carriers ready for storing in parking area and later on loading into a tray setting system.

The baskets 7 full of items are moved off the clean side conveyor and parked on the table 10. On this table the items are repacked into bins for inspection and volume reasons (one type of item per bins).

If the items are not china or glass, the items can be dumped from the baskets to the bins over a dump edge and with the help of a plastic funnel device (not shown). The funnel device makes sure that the items are funnelled into the bins.

All the filled bins are stored on a table as switchyard, and then bins are stored into carriers positioned in carrier lifters, so that the bins can easily be slid in and not lifted (ergonomic reasons).

After the carriers are filled, the carrier is lowered onto a dolly or stacked on another carrier with a carrier lifter. Now the carriers are ready to be stored in the parking area ready for use on a tray setting system.

Operation of the stripping system:

The stripping station A is normally two sided, one for trays and one side for bulk.

From a trolley 5 or trolley for standard boxes trays (not shown) full of used items and garbage are removed and dumped on the stripping conveyor (going to left).

The conveyor is moving along loaded with items and garbage. A first operator is removing tray and glass and putting those items into washing baskets 7 (only one type of items per basket). A second operator is removing cutlery and other items from stripping belt and putting them into washing baskets (only one type of items per basket). Any operator is removing the rest of useful items and putting them in washing baskets. The rest of the garbage is dumped from the stripping conveyor 4 into the garbage handling system (e.g. vacuum suction device 11).

On the bulk side drawers are emptied and the items put into separate baskets (not to be washed). An end table is mostly used for emptying glass racks and turning the glasses upside down for draining (table has drain). Every time a washing basket 7 is full, the basket is pushed to the basket conveyor 6 and starts moving to the right. The baskets are queued (buffer zone) in front of the tunnel washer 2. A full load of baskets goes normally through the tunnel washer. Clean washing baskets full of items are separated by the conveyor 6 and stored on a roller section 10 for handling. The unpacking/changing of items into bins is done on tables or on the clean side packing system (roller table 10).

A second system returns the empty baskets 7 to the stripping station A. The baskets 7 are dumped on two return conveyors 8, 9 above and underneath the roller section (to separate low and high baskets) and are conveyed to the top of the stripping system (above stripping station A). There the baskets are presented to the operators to take them down in two tiers, one for low baskets (normally with pegs) and one for high baskets. The removal is possible from both sides and from the rear end (table end too)

What is claimed is:

1. A system for stripping soiled trays and bulk items returned from meal services, and for cleaning items to be reused, comprising a stripping station on a dirty side of the system, in which the items to be cleaned are put into washing baskets, a tunnel washer for washing baskets filled with the items, on a clean side of the system, a storing and unpacking station with a table for storing and unpacking cleaned items from the washing baskets, and a washing basket return device for returning clean, emptied washing baskets from the storing and unpacking station to said stripping station, said washing basket return device including two motor-driven return conveyors, one arranged above and the other arranged underneath said table at the storing and unpacking station, both conveyors leading back to the top of the stripping station for removal of clean, emptied washing baskets by an operator working in the stripping station.

2. The system as claimed in claim 1, wherein said return conveyor arranged underneath the table for storing and unpacking has a limited height freedom and is provided for low baskets and said return conveyor arranged above the table is provided for high baskets.

3. The system as claimed in claim 1 or 2, wherein each return conveyor separates before reaching an end section of the stripping station into two tracks, so that an operator can reach the washing baskets from opposite sides of the stripping station.

4. The system as claimed in claim 1, wherein means are provided for separating abutting washing baskets when leaving the tunnel washer.

5. The system as claimed claim 1, wherein said table for storing and unpacking includes a roller section for handling clean washing baskets.

* * * * *